US005610696A

United States Patent [19]

Kemmochi et al.

[11] Patent Number: 5,610,696

[45] Date of Patent: Mar. 11, 1997

[54] IMAGE FORMING APPARATUS HAVING DEVELOPER CARRYING MEMBER SUPPLIED WITH OSCILLATING VOLTAGE

[75] Inventors: Kazuhisa Kemmochi; Shigeru Ohki, both of Yokohama; Hiroyuki Suzuki, Machida, all of Japan

[73] Assignee: Canon Kabushiki Kaisha, Tokyo, Japan

[21] Appl. No.: 396,705

[22] Filed: Mar. 1, 1995

Related U.S. Application Data

[63] Continuation of Ser. No. 214,213, Mar. 17, 1994, Pat. No. 5,424,812.

[30] Foreign Application Priority Data

Mar. 19, 1993 [JP] Japan ..... 5-085403

[51] Int. Cl.[6] ..... G03G 15/08

[52] U.S. Cl. ..... 399/285

[58] Field of Search ..... 355/261, 265, 355/245, 246, 251; 118/656, 657, 658, 647; 430/35, 122

[56] References Cited

U.S. PATENT DOCUMENTS

| | | | |
|---|---|---|---|
| 4,395,476 | 7/1983 | Kanbe et al. | 430/102 |
| 4,610,531 | 9/1986 | Hayashi et al. . | |
| 4,746,589 | 5/1988 | Haneda et al. | 430/102 |
| 4,904,558 | 2/1990 | Nagatsuka et al. | 430/122 |
| 5,003,351 | 3/1991 | Waki et al. | 355/259 X |
| 5,187,535 | 2/1993 | Tajima | 355/326 |
| 5,250,382 | 10/1993 | Shimojo et al. | 430/109 |
| 5,257,075 | 10/1993 | Ohki | 355/246 |
| 5,310,615 | 5/1944 | Tanikawa | 430/106.6 |

FOREIGN PATENT DOCUMENTS 2174317 11/1986 United Kingdom .

OTHER PUBLICATIONS

*Patent Abstracts of Japan,* vol. 9, No. 182,P376, Mar. 28, 1985 for Document 60–53968.

*Patent Abstracts of Japan,* vol. 9, No. 299, P408, Jul. 17, 1985 for Document 60–134262.

*Patent Abstracts of Japan,* vol. 18, No. 689, P1850, Sep. 30, 1994 for Document 06–274017.

*Patent Abstracts, of Japan,* vol. 9, No. 329 (P–416) (2052), Dec. 24, 1985 for Document JP60–154260.

*Patent Abstracts of Japan,* vol. 12, No. 180 (P–709), Dec, 16, 1987 for Document JP62–289858.

*Patent Abstracts of Japan,* vol. 16, No. 179, (P–1345), Jan. 23, 1992 for Document JP43–19677.

*Patent Abstracts of Japan,* vol. 17, No. 210 (P–1526), Mar. 12, 1992 for Document JP 43–48367.

*Primary Examiner*—R. L. Moses

*Attorney, Agent, or Firm*—Fitzpatrick, Cella, Harper & Scinto

[57] ABSTRACT

An image forming apparatus includes an image bearing member for bearing an electrostatic latent image; developer carrying member for carrying a developer comprising toner particles; a voltage source for applying to the developer carrying member an oscillating voltage having a predetermined frequency; wherein the following is satisfied:

$$|Vpp-2Vcont|/16Vf^2<d^2/|Q|$$

where Vpp (V) is a peak-to-peak voltage of the oscillating voltage, Vf (Hz) is the frequency of the oscillating voltage, Vcont (V) is a potential difference between a voltage of a DC component of the oscillating voltage and a potential of an image portion on the image bearing member when a maximum image density is provided, Q (c/kg) is an average triboelectric charge amount of the toner particles, and d (m) is a gap between the image bearing member and the developer carrying member.

4 Claims, 10 Drawing Sheets

IMAGE FORMING APPARATUS HAVING DEVELOPER CARRYING MEMBER SUPPLIED WITH OSCILLATING VOLTAGE

This application is a continuation of application Ser. No. 08/214,213, filed Mar. 17, 1994 U.S. Pat. No. 5,424,812.

FIELD OF THE INVENTION AND RELATED ART

The present invention relates to an image forming apparatus such as a copying machine, printer or the like, and more particularly to an image forming apparatus in which an electrostatic latent image is formed on a photosensitive member by selective actuation of a laser beam.

Recently, digital image formation is being used in the field of a copying machine or printer as a result of demand for full-color image or systematic arrangement. For example, a laser beam printer has been widely used in which a latent image bearing member is scanned with a laser beam, and a desired image is formed in the latent image bearing member (such as a photosensitive drum or the like) by selective actuation of the laser beam.

The typical usage of such laser beam printers is for binary level recording of characters, graphics or the like. In this case, the recording of dots, characters, graphics or the like does not require halftone level recording, and therefore, the structure of the printer is rather simple.

On the other hand, a printer capable of forming tone images in the binary level type, such as printer using a dithering method, density pattern method or the like, is known. However, as is well known, a high resolution image can not be obtained using the dithering method or the density pattern method.

Under these circumstances, a proposal has been made recently in which a halftone level dot is formed for each pixel without reducing the high recording density. This is done by modulating a pulse width (PWM) of the laser beam in accordance with the image signal. Using this method, a high resolution and high tone reproduction image can be produced.

However, in a halftone region having a reflection density of not more than 0.3 in such an apparatus, roughness or white stripes appear in the image. The defects are not so notable in the case of characters, but they are very much notable in a low density region in the case of a photographic image or the like.

Investigations have been made as to the causes of this roughness.

In the case of using a two component developer, the following has been found.

When a high light portion latent image is formed by latent image dots, the latent image on the photosensitive member is not a broad image as in an analog latent image, if it is seen microscopically, but it is rather local images. If the density is further reduced, then the latent image becomes dull because of the influence of the film thickness of the photosensitive member with the result of gradual decrease in the maximum contrast potential V0, as shown in FIG. 5. For example, if an attempt is made to reproduce an image having a reflection image density of approx. 0.2, then the potential of the latent image V0 is approx. 150–200 V. In the case of a reverse-development, the surface potential of the non-image portion is 100–200 V higher than the DC component of the developing bias voltage to avoid a foggy background, and therefore, the potential difference Vcont from the DC component of the developing bias when the voltage V0 is 150–250 V, is 0–100 V, approx. The Vcont of 0–100 V means that the toner particles are placed in an unstable state, that is, they may be deposited onto the photosensitive member or onto the developing sleeve. For this reason, when the latent image is developed by the two component developer, the contact state of a magnet brush is significantly influential to a development efficiency, and therefore, the image roughness occurs due to the missing of dots or the like corresponding to the non-uniformity of the magnetic brush.

In the case of using non-magnetic one component developer, the following has been found.

A similar situation occurs when non-magnetic one component developer is used in place of the two component developer used. When the high light latent image having the contrast potential difference Vcont of 0–100 V approx. is used (the toner particles are unstable), the state of toner application on the developing roller is significantly influential to the development efficiency, and the white stripes and image roughness appear due to the missing of dots corresponding to the non-uniformity of the toner application of the developing roller.

In the developing device using the non-magnetic one component developer, a foggy background (deposition of the toner to the non-image zones on the photosensitive drum) easily occurs in the normal usage state. This is one of the defects of the conventional non-magnetic one component developing operation.

SUMMARY OF THE INVENTION

Accordingly, it is a principal object of the present invention to provide an image forming apparatus capable of forming a high density solid image without foggy background.

It is another object of the present invention to provide an image forming apparatus in which partial voids in the image in a high light zone is prevented.

According to an aspect of the present invention, there is provided an image forming apparatus, comprising: an image bearing member for bearing an electrostatic latent image; a developer carrying member for carrying a developer comprising toner particles; and voltage applying means for applying to the developer carrying member an oscillating voltage having a predetermined frequency: wherein the following is satisfied:

$$|Vpp-2Vcont|/16Vf^2<d^2/|Q|$$

where Vpp (V) is a peak-to-peak voltage of the oscillating voltage, Vf (Hz) is the frequency of the oscillating voltage, Vcont (V) is a potential difference between a voltage of a DC component of the oscillating voltage and a potential of an image portion on the image bearing member when a maximum image density is provided, Q (c/kg) is an average triboelectric charge amount of the toner particles, and d (m) is a gap between the image bearing member and the developer carrying member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 3:
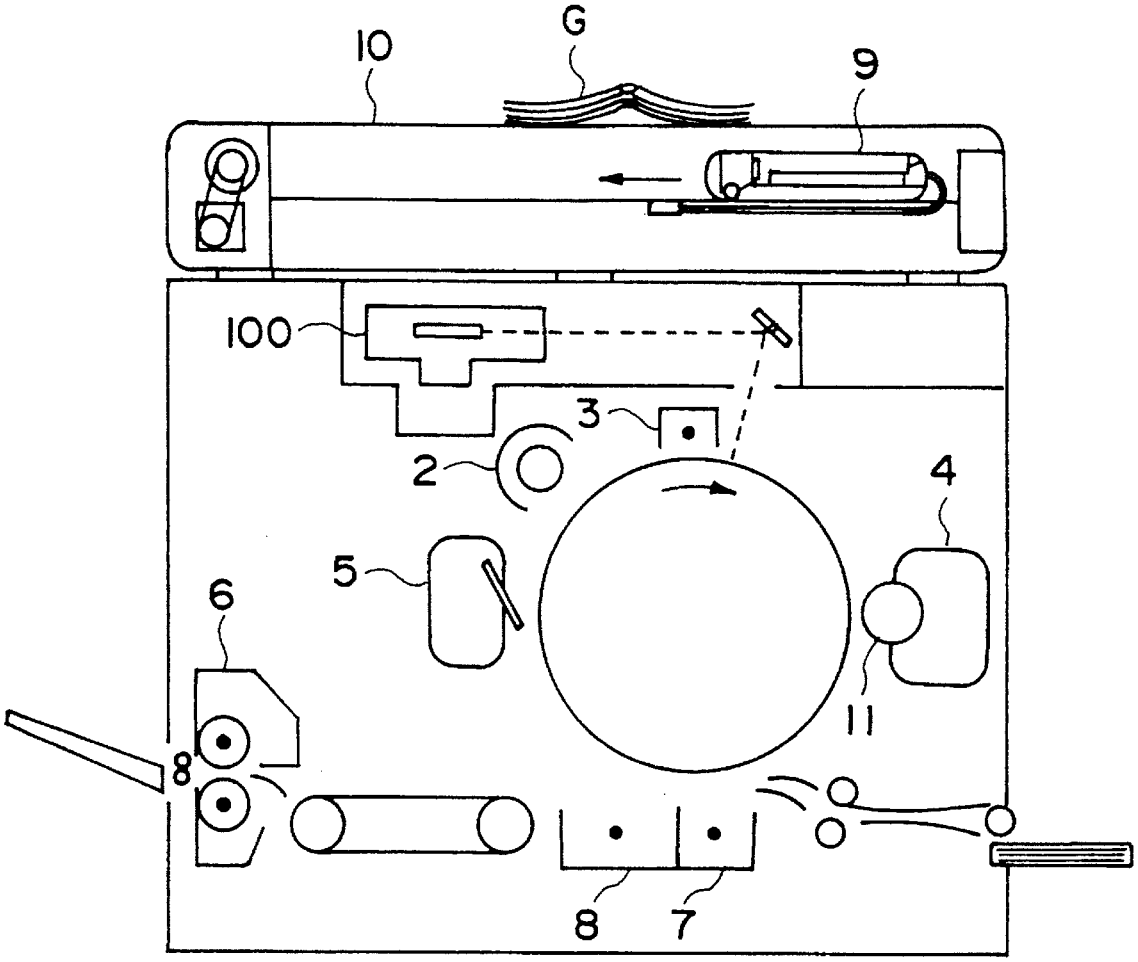
FIG. 3 is a sectional view of an electrophotographic copying apparatus of digital type usable with the present invention.

Referring to FIG. 3, there is shown an image forming apparatus according to an embodiment of the present invention. On an original supporting platen 10, an original G is placed face down. Subsequently, a copy switch is depressed to start the copying operation. The original G is illuminated and scanned by a unit 9 integrally having an original illumination lamp, a short-focus lens array and a CCD sensor. In the unit 9, the light reflected from the original is imaged by the short-focus lens array and is incident on the CCD sensor. The CCD sensor comprises a light receiving portion, a transfer portion and an output portion. The light receiving portion of the CCD element converts the light signal to an electric signal, which is transferred sequentially to an output portion in synchronism with clockpulses, by the transfer portion. In the output portion, the charge signal is converted to a voltage signal, which is amplified and reduced in impedance, and then is outputted. The analog signal thus produced is subjected to a known image processing operation, and is converted to a digital signal which is sent to the printer.

In the printer, an electrostatic latent image is formed in response to the image signal. A latent image bearing member in the form of an electrophotographic photosensitive drum 1 is rotated at a predetermined peripheral speed about a central axis, and is uniformly charged by the charger 3 to the positive or negative polarity. Subsequently, the uniformly charged surface of the photosensitive drum 1 is scanned with a laser beam modulated in accordance with the image signal, through a laser scanner 100, so that an electrostatic latent image is gradually formed corresponding to the original image, on the photosensitive drum 1.

Figure 4:
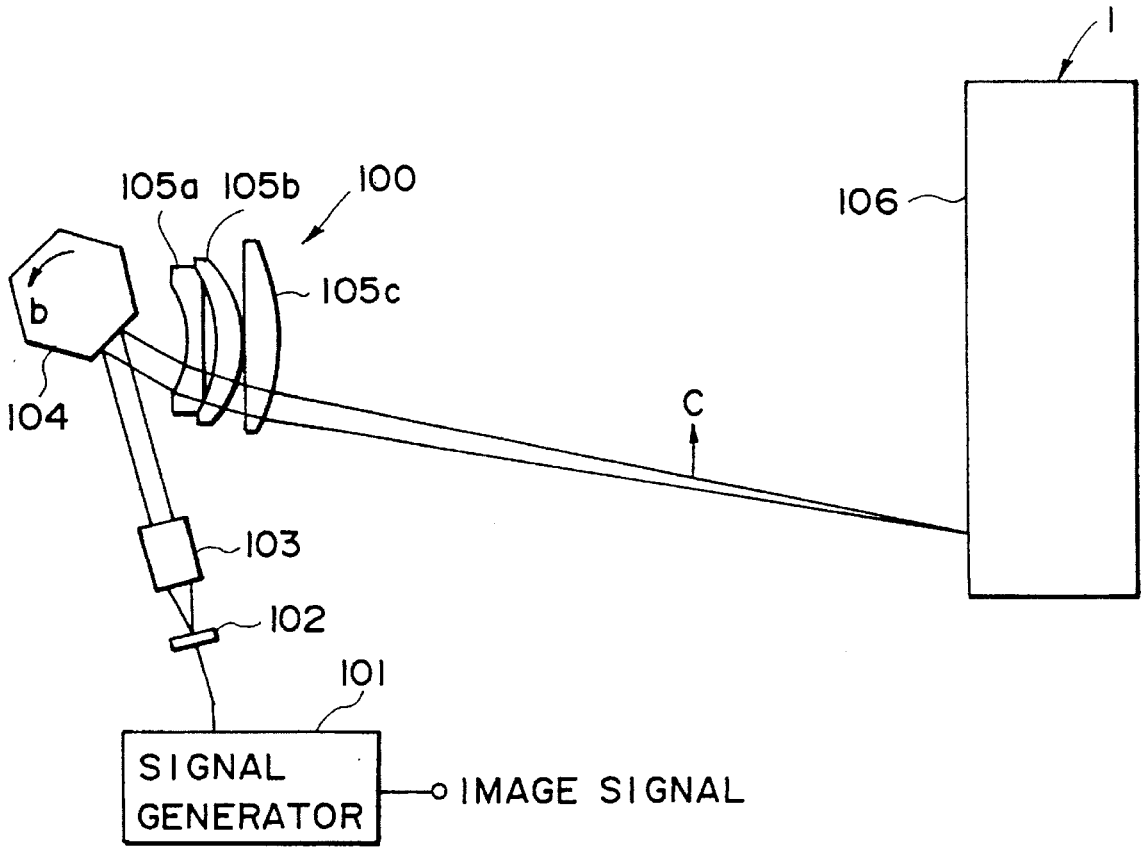
FIG. 4 illustrates a laser scanner used in the copying apparatus of FIG. 3.
Figure 5:
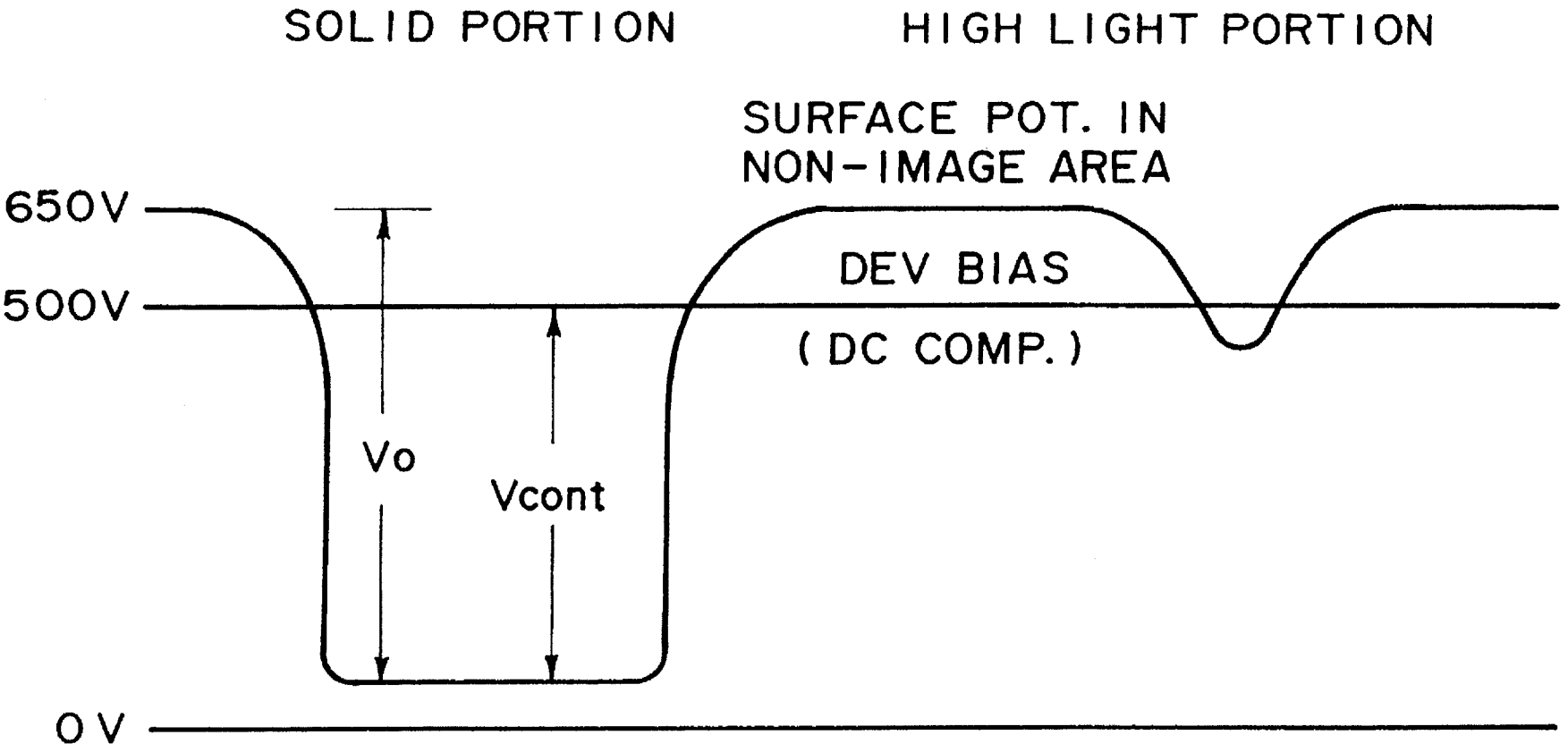
FIG. 5 is a graph of surface potential of the solid image portion and high light portion.
Figure 6:
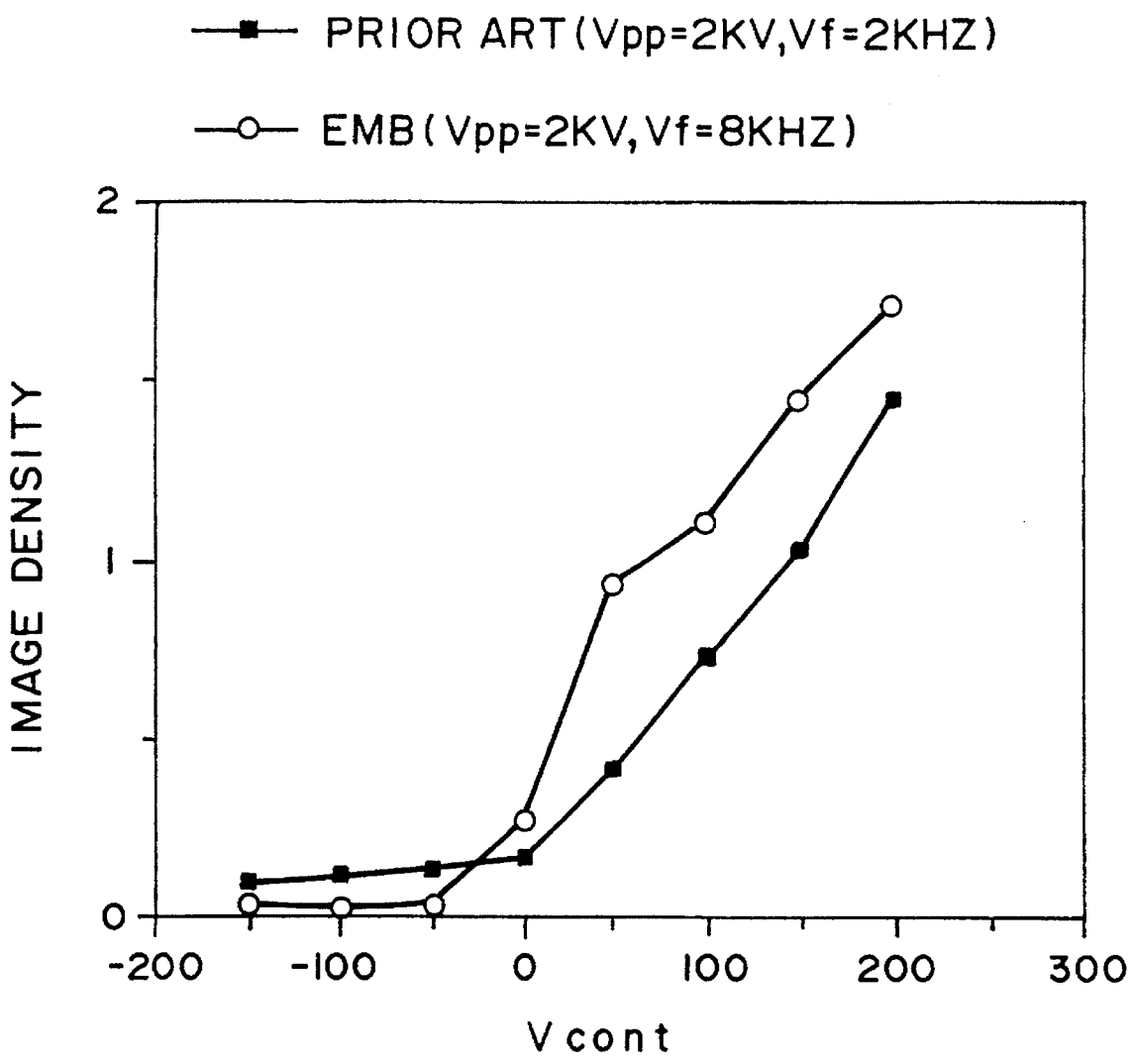
FIG. 6 is a graph of Vcont and image density in the case of analog latent image formation, with a conventional developing bias condition and a present invention bias condition.

Referring to FIG. 4, there is schematically shown the structure of the laser scanner 100. When the laser beam is deflected by the laser scanner 100, a solid laser element 102 is actuated or deactuated at predetermined timing by light signal generator 101 on the basis of the supplied image signal. The laser beam emitted from the solid laser element 102 is converted to an a focal beam by a collimator lens 103, and is deflected in the direction C by a rotatable polygonal mirror 104 rotating in the direction b, and is imaged as a spot on the surface to be scanned 106 of the photosensitive drum by the f-θ lens groups 105*a*, 105*b* and 105*c*.

By the laser beam scanning, an exposure distribution corresponding to one scanning line of the image is provided on the surface 106 of the photosensitive drum 1. The surface 106 is scrolled through a predetermined distance in a direction perpendicular to the scanning direction, by which an exposure distribution corresponding to the image signals, is provided on the surface 106 to be scanned.

The electrostatic latent image thus formed on the photosensitive drum is visualized into a toner image by a developing device 4.

Figure 1:
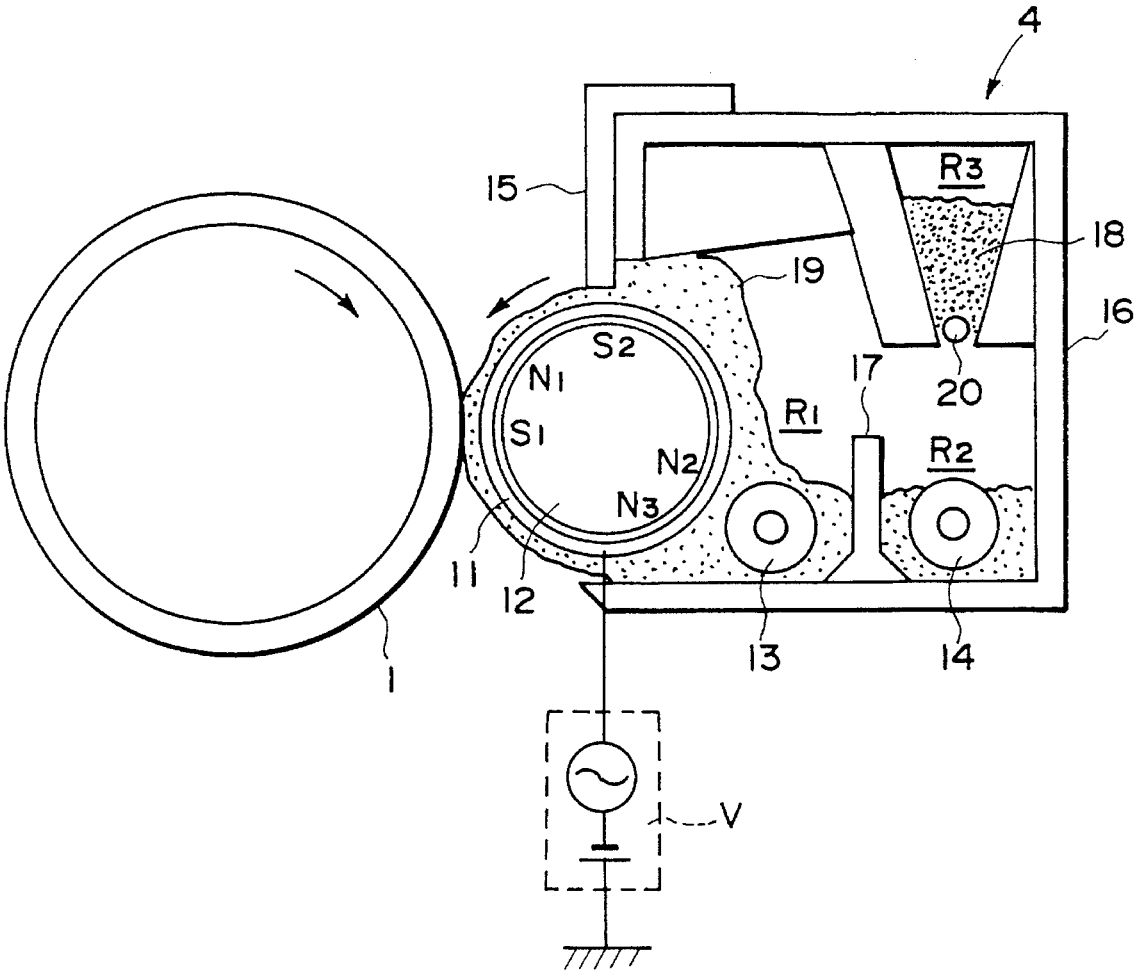
FIG. 1 is a sectional view of a developing apparatus using a two component developer usable with an image forming apparatus according to an embodiment of the present invention.

Referring to FIG. 1, an exemplary image forming apparatus 4 using two component developer comprising toner particles will be described and magnetic particles. The developing device 4 comprises a developer container 14 having an opening in which a developing sleeve 11 is rotatably supported to face the photosensitive drum 1. In the developing sleeve 11, a magnetic field generating means in the form of a magnet roller 12 having a plurality of magnetic poles is stationarily disposed. In the developer container 14, there are disposed stirring screws 13 and 14 and a regulating blade 15 for forming a thin layer of the developer on the developing sleeve surface. Designated by a reference V is a voltage source for applying an oscillating voltage to the developing sleeve 11.

Here, the description will be made as to the developing process and the circulation system of the developer for visualizing an electrostatic latent image through a two component magnetic brush using the above-described developing device 4.

With the rotation of the developing sleeve 11, the developer 19 taken up by the magnetic pole N2 of the magnet roller 12 is regulated by a regulating blade 15 extended substantially perpendicular to the surface of the developing sleeve 11, in the process of being conveyed from the pole N2 portion to the pole N1 portion, and it is formed as a thin layer on the developing sleeve 11. The developer in the form of the thin layer is conveyed to a main developing pole S1, where chains are formed by the magnetic force. The developer in the form of the chains is used to develop the electrostatic latent image. Thereafter, the developer on the developing sleeve 11 is returned into the developer container 16 by the repelling magnetic field provided by the magnetic poles N3 and N2.

The electrostatic latent image formed on the photosensitive drum 1 can be visualized by the developing apparatus 4 using the two component developer. However, it can be visualized by a developing apparatus using non-magnetic one component developer as the developer.

Figure 2:
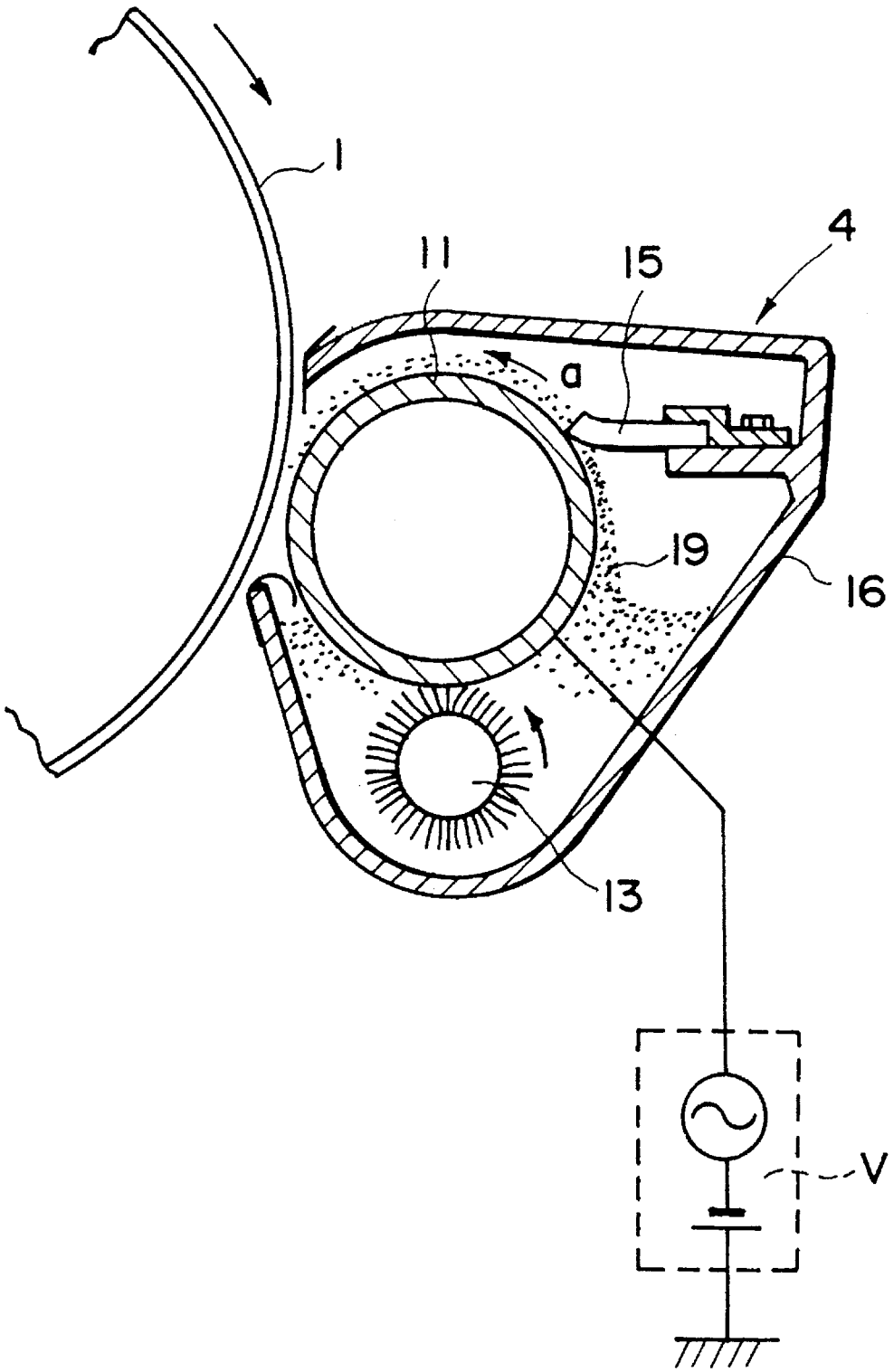
FIG. 2 is a sectional view of a developing apparatus using a non-magnetic one component developer usable with an image forming apparatus according to an embodiment of the present invention.

Referring to FIG. 2, there is shown an exemplary developing apparatus 4 using a non-magnetic one component developer as the developer. As compared with the developing apparatus using the two component developer described above, the developing apparatus of FIG. 2 is advantageous from the standpoint of the downsizing of the developing apparatus, and therefore, that of the entire image forming apparatus. In another developing apparatus, magnetic one component developer is used as the developer. The magnetic developer is required to contain therein magnetic material to acquire the magnetic property, with the result of poor image fixing of the toner image on a transfer sheet, and that the color reproducibility is poorer than the two component developer because of the magnetic material (usually magnetic material is black) is contained in the developer particles.

Referring to FIG. 2, the developing device 4 comprises a developer container 16 which contains non-magnetic one component developer comprising non-magnetic toner particles. The container 16 is provided with an opening in which a developing roller as a developer carrying member is rotatably supported therein to face the photosensitive drum 1. The developing roller 11 is in the form of a non-magnetic sleeve (aluminum, stainless steel or the like). In this embodiment, the developing roller 11 is rotated in a direction a by an unshown driving source. The surface of the developing roller 11 has a roughness of 2–5 μm to assure the carrying of the toner. The non-magnetic toner 12 is retained adjacent the bottom of the developer container 16, that is, below the developing roller 11, and is supplied onto the developing roller 11 by a take-up roller 13. The take-up roller 13 is also effective to stir the toner on the developing roller 11 after the developing action and the toner 19 in the developer container. The toner thus taken up on the developing roller is regulated while being triboelectrically charged, by an end of a rubber blade 15, and is applied on the developing roller 11.

The toner thus applied is transferred from the developing roller 11 onto the photosensitive drum 1 by a developing bias in the form of a superimposed alternating voltage and a DC voltage.

The toner image thus formed on the photosensitive drum 1 is electrostatically transferred onto a transfer material by a transfer charger 7, as shown in FIG. 3. Thereafter, the transfer material is electrostatically separated by a separation charger 8 and is fed into an image fixing device 6, where the transfer material is subjected to a heat-fixing operation. Thus, a print is produced.

The surface of the photosensitive drum 1, after the toner image transfer, is cleaned by a cleaner 5 so that the residual toner or other contamination is removed. Then, the photosensitive member is repeatedly usable for the image forming operation.

The description will be made as to a first embodiment using the two component developer, referring to FIG. 1.

EMBODIMENT 1

The photosensitive drum 1 (latent image bearing member) has an outer diameter of 80 mm, and the inside of the developer container 16 of the developing device 4 is divided by a partition wall 17 into a developing chamber (first chamber) R1 and a stirring chamber (second chamber) R2. Above the stirring chamber R2, a toner container R3 is formed with a partition 17 therebetween. A developer 19 is contained in the developing chamber R1 and the stirring chamber R2. In the toner container R3, the toner (non-magnetic toner) 18 for supply is contained. The toner containing chamber R3 is provided with a supply opening 20, and the toner 18 is supplied into the stirring chamber R2, accordance with the consumption of the toner, through the supply opening 20.

In the developing chamber R1, there is provided a feeding screw 13 which conveys the developer 19 in the developer chamber R1 in the direction of the length of the developing sleeve 11 by the rotation thereof. Similarly, a conveying screw 14 is provided in the containing chamber R2 to convey the toner supplied into the stirring chamber R2 through the supply opening 20 in the direction of the length of the developing sleeve 11, by the rotation thereof.

The developer 19 used in this embodiment is a two component developer containing non-magnetic toner and magnetic particles (carrier particles). The mixture ratio of the non-magnetic toner and the magnetic particles is such that the content by weight of the non-magnetic toner is approx. 5%. Here, the non-magnetic toner particles have a volume average particle size of approx. 8 μm. The magnetic particles are ferrite particles (maximum magnetization of 60 emu/g) coated with resin material. The weight average particle size is 50 μm. The particles have electric resistance of $10^8$ Ωcm or higher. The magnetic permeability of the magnetic particles is approx. 5.0.

The developer container 16 is provided with an opening at a position close to the photosensitive drum 1. A developing sleeve 11 is exposed through the opening, and the developing sleeve 11 is disposed with a space of 500 μm from the photosensitive drum 1. The outer diameter of the developing sleeve 11 of the non-magnetic material is 32 mm, and it is rotated at a peripheral speed of 280 mm/sec.

The magnetic field generating means in the form of a magnet roller (magnet 12) stationarily disposed in the developing sleeve 11 has a developing magnetic pole S1, a magnetic pole N3 disposed downstream thereof, and magnetic poles N2, S2 and N1 for conveying the developer 19. The magnet 12 is disposed within the developing sleeve 11 such that the developing magnetic pole S1 is faced to the photosensitive drum 1. The magnetic pole S1 is effective to form a magnetic field in the developing zone between the developing sleeve 11 and the photosensitive drum 1. The magnetic field functions to form a magnetic brush.

A regulating blade 15 is disposed above the developing sleeve 11 and functions to regulate the thickness of the developer 19 layer on the developing sleeve 11. It is made of non-magnetic material such as aluminum, SUS316 or the like. The gap between the developing blade 15 and the developing sleeve 11 is 800 μm in this embodiment.

The toner used comprises two kinds, i.e., one having a triboelectric charge amount of approx. $2.0\times10^{-2}$ C/kg and one having a triboelectric charge amount of approx. $3.0\times10^{-2}$ C/kg.

The method of measuring the triboelectric charge amount of the toner (two component developer) will be described, reference to FIG. 7.

The charge amount measuring device is provided with a measuring container 42 made of metal having a conductive screen 43 of 500 mesh at the bottom. The two component developer to be subjected to the measurement of the triboelectric charge amount is fed into a polyethylene bin having a capacity of 50–100 ml, and 0.5–1.5 g of the developer is pored into the measuring container 42, and the container is capped with a cap 44. The weight of the entire measuring container 42 is measured (W1 (kg)). Measuring container 42 is placed on a sucking machine 41 in which at least a portion in contact with the measuring container 42 is insulative. The toner is sucked through the sucking port 47, and a control valve 46 is actuated to provide 250 mmAq of vacuum, measured by gauge 45. In this state, the sucking operation is continued for a sufficient period of time, preferably, for 2 minutes thus removing the toner resin material. A potential difference is measured by a potentiometer 49 connected in series with a capacitor (capacitance C (F)) 48 between the measuring container 42 and ground. The lead thereof is V. After the sucking operation, the weight of the entirety of the measuring container 42 is measured (W2 (kg)). The triboelectric charge amount of the toner is calculated as follows:

triboelectric charge amount of toner (C/kg)=C×V×$10^{-3}$/(W1−W2)

In this embodiment, a high light half tone image having an image density of approx. 0.2 and a solid image are produced, and an evaluation is made on the basis of the smoothness of the high light half tone image and the density of the solid image. The electrostatic latent image forming conditions are as follows.

The photosensitive drum 1 is uniformly charged to 650 V by a charger 3 when a high light half tone image is to be produced, the PWM exposure (pulse width modulation) is carried out with a semiconductor laser to reduce the surface potential to approx. 450 V. On the other hand, when a solid image is formed, it is reduced to approx. 100 V (Vcont=400 V). In this embodiment, the latent image is visualized through reverse-development. Subsequently, the developing step will be described.

In the developing device 4 shown in FIG. 1, the developing sleeve 11 carries the developer 11 at a position adjacent to the magnetic pole N2, and with the rotation of the developing sleeve 11, the developer 19 is fed to the developing zone. When the developer 19 reaches the neighborhood of the developing zone, the magnetic particles of the developer 19 form chains by the magnetic force of the magnetic pole S1, which stand erect from the developing sleeve 11 to form a magnetic brush of the developer 19. The free ends of the magnetic brush rub the surface of the photosensitive drum 1. By the application of a voltage in the form of an AC biased DC voltage (500 V) between the developing sleeve 11 and the photosensitive drum 1, the toner on the magnetic brush is deposited on the latent image portion of the photosensitive drum 1.

In this embodiment, the amplitude Vpp of the alternating voltage component is fixed to 2000 V, and the frequency Vf is changed for the toner having the triboelectric charge amount of approx. 2.0×$10^{-2}$ C/kg and the toner having the triboelectric charge amount of approx. 3.0×$10^{-2}$ C/kg, with the above-described latent image forming conditions. The produced images are evaluated. As a result, as will be understood from Table 1 below, both the high density in the solid image and the reproducibility in the high light region, were satisfactory only when A<B.

TABLE 1

| Tribo. | Vf (Hz) | Solid image | High light image | A $\frac{\lvert V_{pp}-2V_{cont}\rvert}{16Vf^2}$ | B $\frac{d^2}{Q}$ |
|---|---|---|---|---|---|
| 2.0 × $10^{-2}$ C/kg | 1000 | 1.58 | N | $7.5\times10^{-5}$ > | $1.3\times10^{-5}$ |
| | 2000 | 1.60 | F | $1.9\times10^{-5}$ > | $1.3\times10^{-5}$ |
| | 4000 | 1.68 | G | $4.7\times10^{-6}$ < | $1.3\times10^{-5}$ |
| | 8000 | 1.78 | E | $1.2\times10^{-6}$ < | $1.3\times10^{-5}$ |
| 3.0 × $10^{-2}$ C/kg | 1000 | 1.50 | N | $7.5\times10^{-5}$ > | $8.3\times10^{-6}$ |
| | 2000 | 1.52 | F | $1.9\times10^{-5}$ > | $8.3\times10^{-6}$ |
| | 4000 | 1.60 | G | $4.7\times10^{-6}$ < | $8.3\times10^{-6}$ |
| | 8000 | 1.75 | G | $1.2\times10^{-6}$ < | $8.3\times10^{-6}$ |

N: No good
F: Fair
G: Good
E: Excellent

Figure 8A:
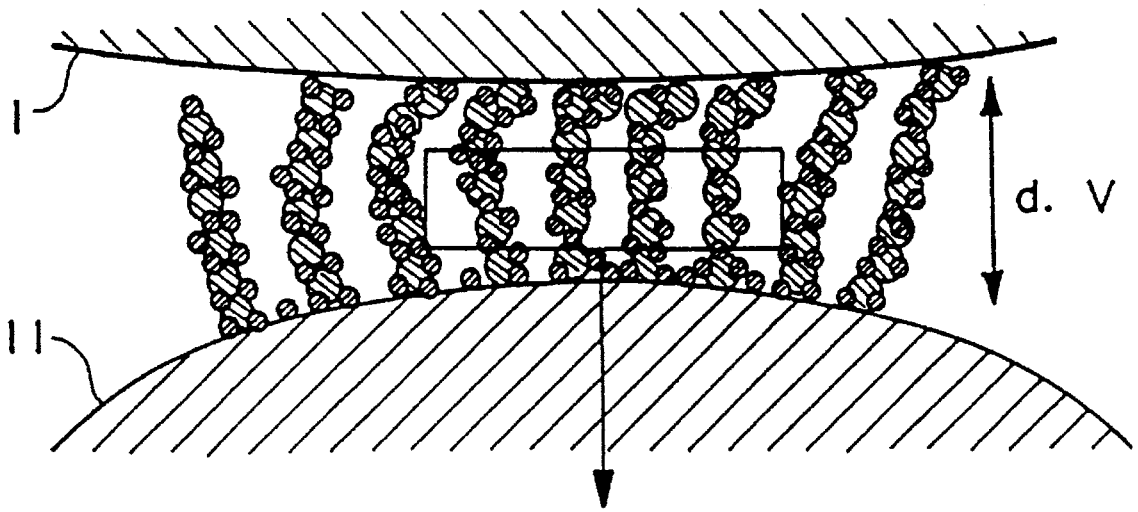
FIG. 8A illustrates forces applied to the toner in the case of two component developer.
Figure 8B:
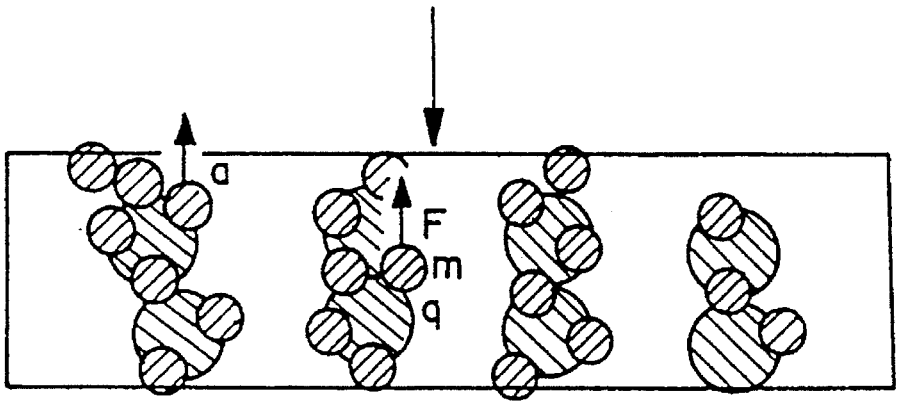
FIG. 8B is an enlarged view of a portion of FIG. 8A.

Here, the significance of A<B will be described. FIG. 8A and 8B show forces applied to one toner particle on the developing sleeve 11. In the figures, q is a charge amount; m is a mass; a is an acceleration; V is a potential difference between the photosensitive drum and the developing sleeve 11; d is a gap between the photosensitive drum 1 and the developing sleeve 11.

An alternating voltage is applied to the toner from the developing sleeve 11 for 1/(2Vf) (sec) in each period. The distance X through which the toner can move during this time is:

$$X = \frac{1}{2}a\left(\frac{1}{2V_f}\right)^2 = \frac{1}{2}\left(\frac{|q|}{m}\cdot\frac{\Delta V}{d}\right)\frac{1}{4V_f^2} = \frac{1}{2}|Q|\cdot\frac{\Delta V}{d}\cdot\frac{1}{4V_f^2} = \frac{|Q|\cdot\Delta V}{8d\cdot V_f^2} \quad (1)$$

The distance X through which the toner can move from the developing sleeve 11 toward the photosensitive drum 1 is:

$$X_+ = \frac{|Q|\cdot\left|\frac{1}{2}V_{pp}+V_{cont}\right|}{8d\cdot V_f^2} \quad (2)$$

On the other hand, the distance X through which the toner can move from the photosensitive drum 1 toward the developing sleeve 11 is:

$$X_- = \frac{|Q|\cdot\left|\frac{1}{2}V_{pp}-V_{cont}\right|}{8d\cdot V_f^2} \quad (3)$$

If the distance X− movable in one period of the removing voltage is not enough for the toner to return from the photosensitive drum 1 to the developing sleeve 11, then X+>X− is satisfied, by which the toner reciprocates toward the photosensitive drum 1. This is satisfied by the distance X− smaller than the gap d between the photosensitive drum 1 and the developing sleeve 11, as follows:

$$\frac{|Q|\cdot\left|\frac{1}{2}V_{pp}-V_{cont}\right|}{8d\cdot V_f^2} < d \rightarrow \frac{|V_{pp}-2V_{cont}|}{16V_f^2} < \frac{d^2}{|Q|} \quad (4)$$

If the developing operation is carried out under this condition, then the missing dot phenomenon does not occur even if voltage V0 is 150–250 V. By the repetition of the reciprocation adjacent the photosensitive drum 1, the toner particles are concentrated on a part of the latent image, so that each dot is reproduced faithfully, and therefore, a uniform halftone image without non-uniformity depending on the state of contacts with the magnetic brush chains, can be produced.

In the non-image portion, the surface potential is normally slightly higher than the DC component of the developing bias voltage as in this embodiment, in order to remove the fog. For this reason, in the non-image portion, Vcont in equations (2) and (3), are negative, and therefore X+<X− is satisfied. Therefore, the toner particles are reciprocated toward the developing sleeve, so that the fog is hardly formed.

EMBODIMENT 2

In Embodiment 1, use is made of a non-magnetic toner having an average particle size of approx. 8 μm and magnetic particles of ferrite particles (maximum magnetization of 60 emu/g) coated with resin materials and having a weight average particle size of 50 μm. They are mixed with the weight ratio of 5:95. In the present embodiment, the average particle size of the non-magnetic toner is approx. 5 μm, and the magnetic particles are of ferrite particles (maximum magnetization of 60 emu/g) coated with the resin material and having a weight average particle size of 30 μm. They are mixed at a weight ratio of 4.5:95.5. Two triboelectric charge amounts, i.e., approx. $2.0\times10^{-2}$ c/kg and approx. $3.0\times10^{-2}$ c/kg, are prepared by changing amount of external addition materials as in Embodiment 1. The experiments of this embodiment are carried out under the same conditions as with Embodiment 1 except for the developer.

Similar to the first embodiment, evaluations are made on the basis of the smoothness of a high light halftone image having an image density of approx. 0.2 and on the image density of a solid image.

As a result, similarly to the first embodiment, only when A<B is satisfied, both of the high image density in the solid image and the satisfactory reproducibility of the high light portion, are satisfied, as will be understood from Table 2. As regards the high light portion, the smooth image could be produced as a result of the use of the smaller toner particle size.

TABLE 2

| Tribo. | Vf (Hz) | Solid image | High light image | A $\frac{\lvert V_{pp}-2Vcont\rvert}{16Vf^2}$ | B $\frac{d^2}{Q}$ |
|---|---|---|---|---|---|
| $2.0\times10^{-2}$ c/kg | 1000 | 1.55 | F | $7.5\times10^{-5}>$ | $1.3\times10^{-5}$ |
| | 2000 | 1.57 | F | $1.9\times10^{-5}>$ | $1.3\times10^{-5}$ |
| | 4000 | 1.64 | G | $4.7\times10^{-6}<$ | $1.3\times10^{-5}$ |
| | 8000 | 1.72 | E | $1.2\times10^{-6}<$ | $1.3\times10^{-5}$ |
| $3.0\times10^{-2}$ c/kg | 1000 | 1.47 | N | $7.5\times10^{-5}>$ | $8.3\times10^{-6}$ |
| | 2000 | 1.50 | F | $1.9\times10^{-5}>$ | $8.3\times10^{-6}$ |
| | 4000 | 1.58 | G | $4.7\times10^{-6}<$ | $8.3\times10^{-6}$ |
| | 8000 | 1.69 | E | $1.2\times10^{-6}<$ | $8.3\times10^{-6}$ |

N: No good
F: Fair
G: Good
E: Excellent

EMBODIMENT 3

This embodiment is different from the first embodiment in that the average particle size of the non-magnetic toner is approx. 8 μm, that the magnetic particles are ferrite particles (maximum magnetization of 60 emu/g) coated with resin material and having an average particle size of 30 μm and that they are mixed at the weight ratio of 7:93. Two triboelectric charge amounts, i.e., $2.0\times10^{-2}$ c/kg and approx. $3.0\times10^{-2}$ c/kg, are prepared by changing amounts of external addition materials.

In this embodiment, the toner content ratio can be increased as compared with Embodiment 1, and therefore, the development efficiency is improved, and therefore, the voltage Vcont is 350 V. In other words, the primary charging potential is 600 V, and the voltage Vdc (the DC component of the developing bias voltage) is 450 V. Except for these conditions, the same conditions as with Embodiment 1 are used.

Similar to the first embodiment, evaluations are made on the basis of the smoothness of a high light halftone image having the image density of approx. 0.2 and on the image density of a solid image. As a result, similarly to the first embodiment, only when A<B is satisfied, both of the high image density in the solid image and the satisfactory reproducibility of the high light portion, are satisfied, as will be understood from Table 3. Because the amount of the toner existing on the developing sleeve is increased, the non-uniformity of contact of chains of the developer hardly occurs, and therefore, smoother images can be produced in the high light portion.

TABLE 3

| Tribo. | Vf (Hz) | Solid image | High light image | A $\frac{\lvert V_{pp}-2Vcont\rvert}{16Vf^2}$ | B $\frac{d^2}{Q}$ |
|---|---|---|---|---|---|
| $2.0\times10^{-2}$ c/kg | 1000 | 1.60 | N | $8.1\times10^{-5}>$ | $1.3\times10^{-5}$ |
| | 2000 | 1.65 | F | $2.0\times10^{-5}>$ | $1.3\times10^{-5}$ |
| | 4000 | 1.72 | G | $5.1\times10^{-6}<$ | $1.3\times10^{-5}$ |
| | 8000 | 1.83 | E | $1.3\times10^{-6}<$ | $1.3\times10^{-5}$ |
| $3.0\times10^{-2}$ c/kg | 1000 | 1.54 | N | $8.1\times10^{-5}>$ | $8.3\times10^{-6}$ |
| | 2000 | 1.57 | F | $2.0\times10^{-5}>$ | $8.3\times10^{-6}$ |
| | 4000 | 1.64 | G | $5.1\times10^{-6}<$ | $8.3\times10^{-6}$ |
| | 8000 | 1.80 | E | $1.3\times10^{-6}<$ | $8.3\times10^{-6}$ |

N: No good
F: Fair
G: Good
E: Excellent

EMBODIMENT 4

In Embodiments 1–3, a voltage in the form of a DC voltage continuously superimposed with an alternating voltage is applied between the developing sleeve 11 and the photosensitive drum 1, by which the toner on the magnetic brush is transferred and deposited onto the latent image portion of the photosensitive drum 1. In the present embodiment, a voltage superimposed with an intermittent alternating voltage, is applied, by which the toner on the magnetic brush is transferred onto and deposited on the latent image portion of the photosensitive drum 1. As the developer, similarly to the first embodiment, the average particle size of the non-magnetic toner is 8 μm, and the magnetic particles are of ferrite particles (maximum magnetization of 60 emu/g) coated with the resin material and having an average particle size of 50 μm. They are mixed at the weight ratio of 5:95.

Figure 9A:
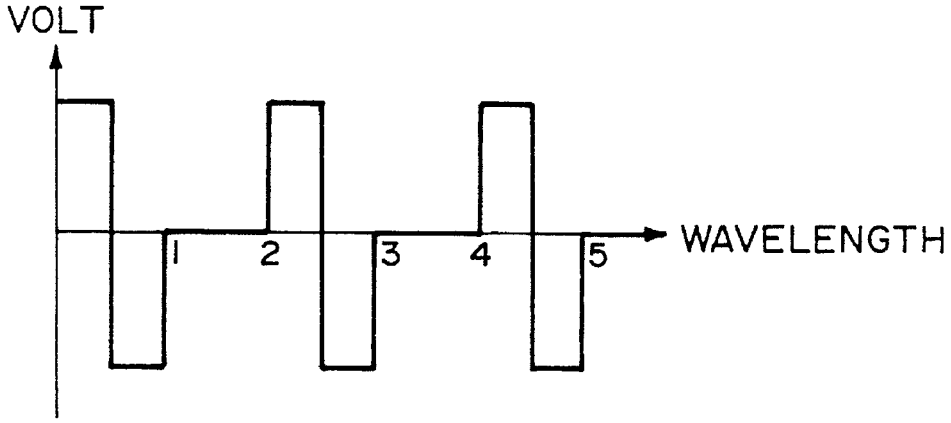
FIG. 9A to 9C are waveforms of a developing bias voltage according to an embodiment of this invention.

In this embodiment, the DC voltage is 500 V, and the amplitude Vpp of the alternating voltage intermittently applied is fixed at 200 V, and the frequency Vf is changed. The triboelectric charge amounts of the toner are approx. $2.0\times10^{-2}$ c/kg and approx. $3.0\times10^{-2}$ c/kg. With these latent image forming conditions, the produced images are evaluated. The time period in which the alternating voltage is not applied is one period for each one period of the alternating voltage, as shown in FIG. 9A.

As a result, as will be understood from Table 4 below, only when A<B is satisfied, both the high density of the solid image and the satisfactory reproducibility of the high light image are satisfied.

TABLE 4

| Tribo. | Vf (Hz) | Solid image | High light image | A $\frac{\lvert V_{pp}-2Vcont\rvert}{16Vf^2}$ | B $\frac{d^2}{Q}$ |
|---|---|---|---|---|---|
| $2.0\times10^{-2}$ c/kg | 1000 | 1.55 | N | $7.5\times10^{-5}>$ | $1.3\times10^{-5}$ |
| | 2000 | 1.58 | F | $1.9\times10^{-5}>$ | $1.3\times10^{-5}$ |
| | 4000 | 1.64 | E | $4.7\times10^{-6}<$ | $1.3\times10^{-5}$ |
| | 8000 | 1.75 | E | $1.2\times10^{-6}<$ | $1.3\times10^{-5}$ |
| $3.0\times10^{-2}$ c/kg | 1000 | 1.48 | N | $7.5\times10^{-5}>$ | $8.3\times10^{-6}$ |
| | 2000 | 1.51 | F | $1.9\times10^{-5}>$ | $8.3\times10^{-6}$ |
| | 4000 | 1.61 | G | $4.7\times10^{-6}<$ | $8.3\times10^{-6}$ |
| | 8000 | 1.74 | E | $1.2\times10^{-6}<$ | $8.3\times10^{-6}$ |

N: No good
F: Fair
G: Good
E: Excellent

The significance of A<B has been described in conjunction with FIG. 8, regarding Embodiment 1. In this embodiment, if the developing operation is performed under the condition defined by the above-described equations (1)–(4), then the toner is not sufficiently capable of reciprocating between the developing sleeve and the photosensitive drum in the one period of the alternating voltage when the voltage V0 is 150–250 V approximately. In addition, when the alternating voltage is stopped, the DC component functions to attract to the photosensitive drum such an amount of the toner as corresponds to the latent image potential, and therefore, the dot missing defect can be avoided. This phenomenon is more remarkable than when the alternating voltage is continuously applied as in Embodiment 1.

By the intermittent repetition of the reciprocation, the toner is concentrated on the latent image portion so that each dot is faithfully reproduced without the non-uniformity due to the state of contact with the magnetic brush, in halftone images. The image thus produced is better than those produced in accordance with Embodiment 1.

In the non-image portion, the surface potential is normally slightly higher than the DC component of the developing bias voltage as in this embodiment in order to avoid the fog. For this reason, the voltage Vcont in equations (2) and (3) is negative in the non-image portion, and therefore X+<X− is satisfied. In addition, the alternating voltage is stopped, and therefore, the DC component functions to attract the toner toward the developing sleeve, and therefore, the toner particles are deviated toward the developing sleeve, and therefore, the fog is further reduced.

Figure 9B:
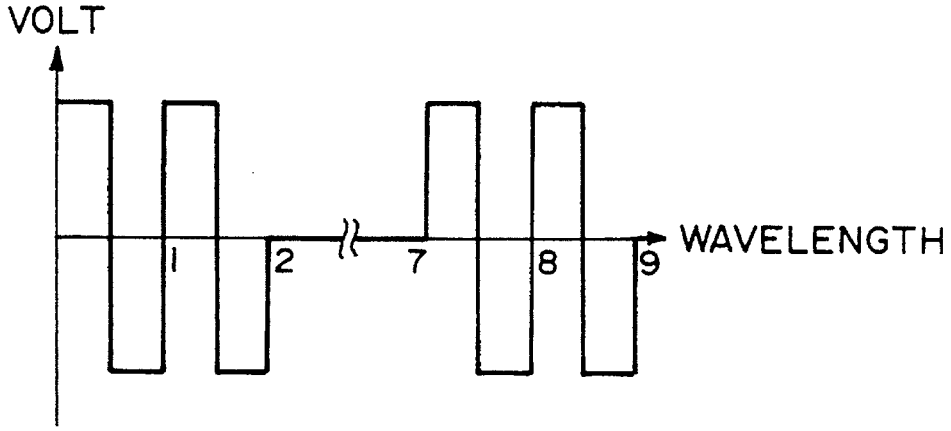
Figure 9C:
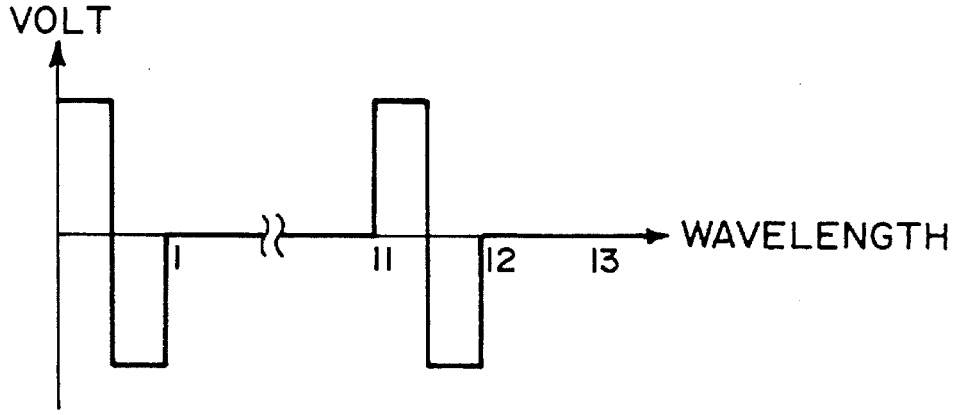

In this embodiment, the alternating voltage applied is as shown in FIG. 9A, but the present invention is not limited to this. For example, as shown in FIG. 9B, two-period application with 5-period rest, or as shown in FIG. 9C, one period-on and 10 period-rest, is usable. In this embodiment, a rectangular waveform is used, which, however, may be replaced with a triangular waveform, sine waveform or the like. The most suitable application can be selected properly by one skilled in the art in accordance with the copying speed or developing conditions.

A ratio of the bias application period and the rest period is preferably 1:(½)–1:15.

EMBODIMENT 5

In this embodiment, as contrasted to Embodiment 4, the average particle size of the non-magnetic toner is approx. 5 μm, and the magnetic particles are of ferrite particles (maximum magnetization of 60 emu/g) coated with resin materials. It has a weight average particle size of 30 μm. They are mixed at the weight ratio of 4.5:95.5. For the triboelectric charge amounts, similarly to Embodiment 4, approx. $2.0\times10^{-2}$ c/kg and approx. $3.0\times10^{-2}$ c/kg, are used. These different triboelectric charge amounts are provided by changing the amount of external addition material.

Similar to the first embodiment, evaluations are made on the basis of the smoothness of a high light halftone image having an image density of approx. 0.2 and on the image density of a solid image.

As a result, similarly to the fourth embodiment, only when A<B is satisfied, both the high image density in the solid image and the satisfactory reproducibility of the high light portion, are satisfied, as will be understood from Table 5. Particularly in the high light portion, smoother images can be produced in the present embodiment than in Embodiment 4, because of the reduction of the toner particle size.

TABLE 5

| Tribo. | Vf (Hz) | Solid image | High light image | A $\frac{\lvert V_{pp}-2Vcont\rvert}{16Vf^2}$ | B $\frac{d^2}{Q}$ |
|---|---|---|---|---|---|
| $2.0\times10^{-2}$ c/kg | 1000 | 1.53 | F | $7.5\times10^{-5}$ > | $1.3\times10^{-5}$ |
| | 2000 | 1.56 | G | $1.9\times10^{-5}$ > | $1.3\times10^{-5}$ |
| | 4000 | 1.66 | E | $4.7\times10^{-6}$ < | $1.3\times10^{-5}$ |
| | 8000 | 1.73 | UE | $1.2\times10^{-6}$ < | $1.3\times10^{-5}$ |
| $3.0\times10^{-2}$ C/kg | 1000 | 1.45 | N | $7.5\times10^{-5}$ > | $8.3\times10^{-6}$ |
| | 2000 | 1.52 | F | $1.9\times10^{-5}$ > | $8.3\times10^{-6}$ |
| | 4000 | 1.60 | E | $4.7\times10^{-6}$ < | $8.3\times10^{-6}$ |
| | 8000 | 1.68 | E | $1.2\times10^{-6}$ < | $8.3\times10^{-6}$ |

N: No good
F: Fair
G: Good
E: Excellent
UE: Ultra-excellent

EMBODIMENT 6

In this embodiment, different from Embodiment 4, the average particle size of the non-magnetic toner is approx. 8 μm, and the magnetic particles are ferrite particles (maximum magnetization of 60 emu/g) coated with the resin material. It has an weight average particle size of 30 μm. They are mixed at the weight ratio of 7:93, thus providing a developer. The triboelectric charge amounts used are approx. $2.0\times10^{-2}$ c/kg and approx. $3.0\times10^{-2}$ c/kg as in Embodiment 1. The different charge amounts are provided by changing the amount of external addition material.

In this embodiment, the toner content can be increased as compared with Embodiment 4. Therefore, the development efficiency is improved, and Vcont is selected to be 350 V. The primary charging potential is 600 V, and Vdc (DC component of the developing bias voltage) is 450 V. As regards the other conditions, conditions similar to Embodiment 4 are used.

Similar to the first embodiment, evaluations are made on the basis of the smoothness of a high light halftone image having the image density of approx. 0.2 and on the image density of a solid image. As a result, similarly to the first embodiment, only when A<B is satisfied, both the high image density in the solid image and the satisfactory reproducibility of the high light portion are satisfied, as will be understood from Table 6. Because of the increase in the amount of the toner existing on the developing sleeve, the non-uniformity of the contacts with the chains of the developer does not easily occur, and therefore, the high light portion of the image is smoother than in Embodiment 5.

TABLE 6

| Tribo. | Vf (Hz) | Solid image | High light image | A $\frac{\lvert V_{pp}-2Vcont\rvert}{16Vf^2}$ | B $\frac{d^2}{Q}$ |
|---|---|---|---|---|---|
| $2.0\times10^{-2}$ c/kg | 1000 | 1.62 | F | $8.1\times10^{-5}$ > | $1.3\times10^{-5}$ |
| | 2000 | 1.66 | G | $2.0\times10^{-5}$ > | $1.3\times10^{-5}$ |
| | 4000 | 1.74 | E | $5.1\times10^{-6}$ < | $1.3\times10^{-5}$ |
| | 8000 | 1.81 | E | $1.3\times10^{-6}$ < | $1.3\times10^{-5}$ |
| $3.0\times10^{-2}$ c/kg | 1000 | 1.52 | N | $8.1\times10^{-5}$ > | $8.3\times10^{-6}$ |
| | 2000 | 1.56 | F | $2.0\times10^{-5}$ > | $8.3\times10^{-6}$ |
| | 4000 | 1.67 | E | $5.1\times10^{-6}$ < | $8.3\times10^{-6}$ |
| | 8000 | 1.81 | E | $1.3\times10^{-6}$ < | $8.3\times10^{-6}$ |

N: No good
F: Fair
G: Good
E: Excellent

A description will be made as to a developing apparatus using one component developer shown in FIG. 2.

EMBODIMENT 7

In this embodiment, one non-magnetic one component developer is charged to the triboelectric charge amount of approx. $2.0\times10^{-2}$ c/kg, and the other is charged to approx. $3.0\times10^{-2}$ c/kg.

High light half tone images having an image density of approx. 0.2 and a solid image are produced. Evaluations have been made on the basis of the smoothness of the high light halftone image and the image density of the solid image. Here, the electrostatic latent image formation for producing the image is as follows.

First, the photosensitive drum is uniformly charged to −650 V by a charger. When a high light halftone image is to be produced, a PWM exposure (pulse width modulation) is effected using a semiconductor laser to decrease the surface potential to approx. 450 V. On the other hand, when a solid image is to be produced, the surface potential is decreased to approx. 300 V (Vcont=200 V). In this embodiment, the developing operation was a reverse-development operation. The developing process will be described.

In the developing apparatus having the structure shown in FIG. 2, a developing bias voltage in the form of a superimposed DC voltage of 500 V and an alternating voltage is applied between a developing roller 11 and the photosensitive drum 1, by which the toner on the developing roller 11 is transferred and deposited on the latent image portion of the photosensitive drum 1. In this embodiment, the amplitude Vpp of the alternating voltage is fixed at 2000 V, and the frequency Vf is changed. The images are produced and evaluated under the above-described latent image forming conditions using the two developers charged to approx. $2.0\times10^{-2}$ c/kg and approx. $3.0\times10^{-2}$ c/kg.

Figure 7:
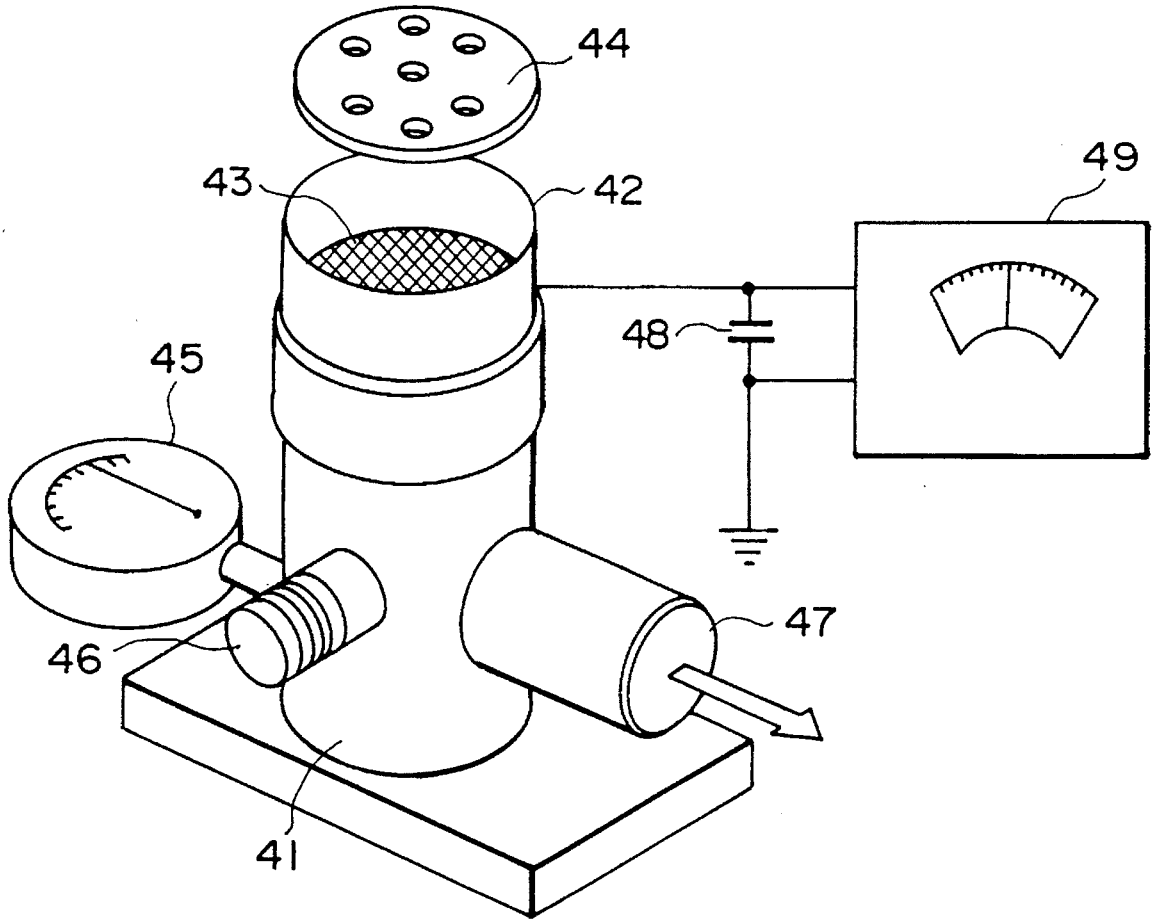
FIG. 7 is a perspective view of an apparatus for measuring triboelectric charge amount of the two component developer.

As will be understood from FIG. 7, only when A<B is satisfied, both the high image density in the solid image and the satisfactory reproducibility of the high light image are accomplished.

TABLE 7

| Tribo. | Vf (Hz) | Solid image | High light image | A $\frac{\lvert V_{pp}-2V_{cont}\rvert}{16Vf^2}$ | B $\frac{d^2}{Q}$ |
|---|---|---|---|---|---|
| $2.0\times10^{-2}$ c/kg | 1000 | 1.46 | N | $1.0\times10^{-4}$ > | $1.3\times10^{-5}$ |
| | 2000 | 1.52 | G | $2.5\times10^{-5}$ > | $1.3\times10^{-5}$ |
| | 3000 | 1.58 | E | $1.1\times10^{-5}$ < | $1.3\times10^{-5}$ |
| | 4000 | 1.65 | E | $6.3\times10^{-6}$ < | $1.3\times10^{-5}$ |
| $3.0\times10^{-2}$ c/kg | 1000 | 1.41 | N | $1.0\times10^{-4}$ > | $8.3\times10^{-6}$ |
| | 2000 | 1.47 | F | $2.5\times10^{-5}$ > | $8.3\times10^{-6}$ |
| | 3000 | 1.54 | G | $1.1\times10^{-5}$ < | $8.3\times10^{-6}$ |
| | 4000 | 1.63 | E | $6.3\times10^{-6}$ < | $8.3\times10^{-6}$ |

N: No good
F: Fair
G: Good
E: Excellent

Figure 10A:
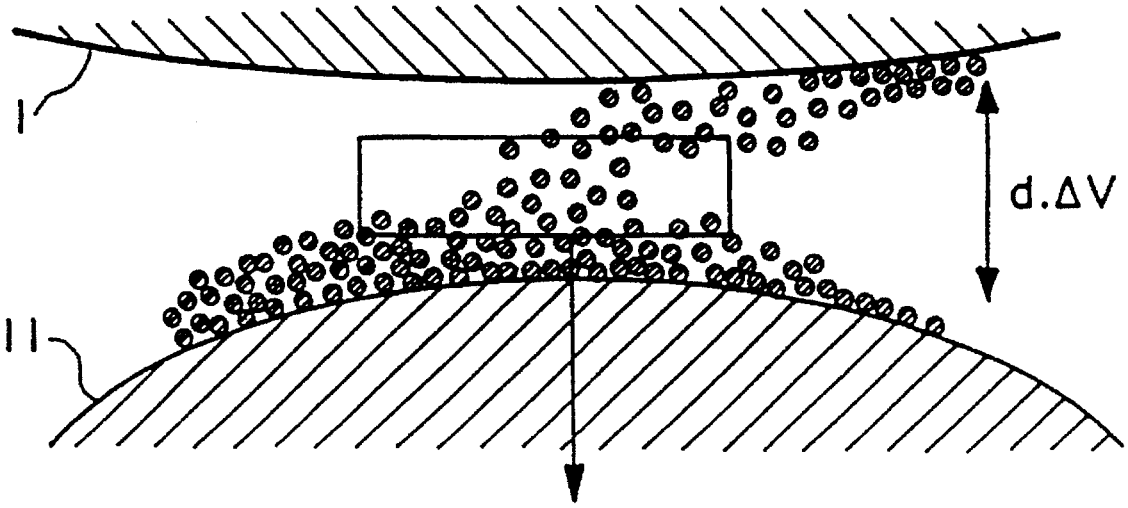
FIG. 10A shows forces applied to the toner in the case of non-magnetic one component developer.
Figure 10B:
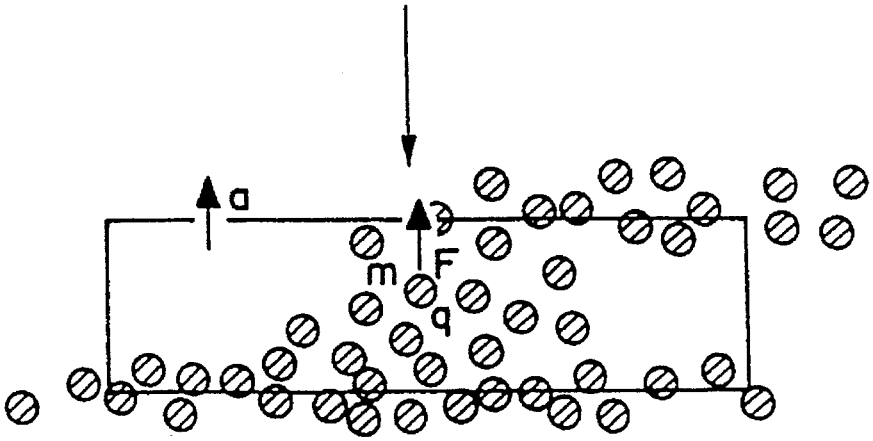
FIG. 10B is an enlarged view of a portion of FIG. 10A.

Here, the significance of A<B will be described. FIG. 10A and 10B show forces applied to one toner particle on the developing sleeve. In the figures, q is a charge amount; m is a mass; a is an acceleration; ΔV is a potential difference between the photosensitive drum and the developing sleeve 11; d is a gap between the photosensitive drum 1 and the developing sleeve 11.

An alternating voltage is applied to the toner from the developing sleeve 11 for 1/(2Vf) (sec) in each period. The distance X through which the toner can move during this is:

$$X = \frac{1}{2}a\left(\frac{1}{2V_f}\right)^2 = \frac{1}{2}\left(\frac{|q|}{m}\cdot\frac{\Delta V}{d}\right)\frac{1}{4V_f^2} = \frac{1}{2}|Q|\cdot\frac{\Delta V}{d}\cdot\frac{1}{4V_f^2} = \frac{|Q|\cdot\Delta V}{8d\cdot V_f^2} \tag{5}$$

The distance X through which the toner can move from the developing sleeve 11 toward the photosensitive drum 1 is:

$$X_+ = \frac{|Q|\cdot\left|\frac{1}{2}V_{pp}+V_{cont}\right|}{8d\cdot V_f^2} \tag{6}$$

On the other hand, the distance X through which the toner can move from the photosensitive drum 1 toward the developing sleeve 11 is:

$$X_- = \frac{|Q|\cdot\left|\frac{1}{2}V_{pp}-V_{cont}\right|}{8d\cdot V_f^2} \tag{7}$$

If the distance X− movable in one period of the removing voltage is not enough for the toner to return from the photosensitive drum 1 to the developing sleeve 11, then X+>X− is satisfied, by which the toner reciprocates toward the photosensitive drum 1. This is satisfied by the distance X− smaller than the gap d between the photosensitive drum 1 and the developing sleeve 11, as follows:

$$\frac{|Q|\cdot\left|\frac{1}{2}V_{pp}-V_{cont}\right|}{8d\cdot V_f^2} < d \rightarrow \frac{|V_{pp}-2V_{cont}|}{16V_f^2} < \frac{d^2}{|Q|} \tag{8}$$

If the developing operation is carried out under this condition, then the missing dot phenomenon does not occur even if the voltage V0 is 150–250 V. By the repetition of the reciprocation adjacent photosensitive drum 1, the toner particles are concentrated on the part of the latent image, so that each dot is reproduced faithfully, and therefore, a uniform halftone image without non-uniformity depending on the state of contacts with the magnetic brush chains, can be produced.

In the non-image portion, the surface potential is normally slightly higher than the DC component of the developing bias voltage as in this embodiment, in order to remove the fog. For this reason, in the non-image portion, Vcont in equations (6) and (7), are negative, and therefore X+<X− is satisfied. Therefore, the toner particles are reciprocated toward the developing sleeve, so that the fog is hardly formed.

EMBODIMENT 8

In Embodiment 7, a voltage in the form of a DC voltage continuously superimposed with an alternating voltage is applied between the developing roller and the photosensitive drum 1, by which the toner on the magnetic brush is transferred and deposited onto the latent image portion of the photosensitive drum 1. In the present embodiment, a voltage superimposed with an intermittent alternating voltage, is applied, by which the toner on the magnetic brush is transferred onto and deposited on the latent image portion of the photosensitive drum 1.

In this embodiment, the DC voltage is 500 V, and the amplitude Vpp of the alternating voltage intermittently applied is fixed at 200 V, and the frequency Vf is changed.

The triboelectric charge amounts of the toner are approx. $2.0\times10^{-2}$ c/kg and approx. $3.0\times10^{-2}$ c/kg. With these latent image forming conditions, the produced images are evaluated. The time period in which the alternating voltage is not applied is one period for each one period of the alternating voltage, as shown in FIG. 9A.

As a result, as will be understood from Table 8 below, only when A<B is satisfied, both the high density of the solid image and the satisfactory reproducibility of the high light image are satisfied.

TABLE 8

| Tribo. | Vf (Hz) | Solid image | High light image | A $\frac{\lvert V_{pp}-2Vcont\rvert}{16Vf^2}$ | B $\frac{d^2}{Q}$ |
|---|---|---|---|---|---|
| $2.0\times10^{-2}$ c/kg | 1000 | 1.44 | N | $1.0\times10^{-4}$ > | $1.3\times10^{-5}$ |
| | 2000 | 1.54 | G | $2.5\times10^{-5}$ > | $1.3\times10^{-5}$ |
| | 3000 | 1.59 | E | $1.1\times10^{-5}$ < | $1.3\times10^{-5}$ |
| | 4000 | 1.61 | E | $6.3\times10^{-6}$ < | $1.3\times10^{-5}$ |
| $3.0\times10^{-2}$ C/kg | 1000 | 1.40 | N | $1.0\times10^{-4}$ > | $8.3\times10^{-6}$ |
| | 2000 | 1.44 | F | $2.5\times10^{-5}$ > | $8.3\times10^{-6}$ |
| | 3000 | 1.52 | G | $1.1\times10^{-5}$ < | $8.3\times10^{-6}$ |
| | 4000 | 1.60 | E | $6.3\times10^{-6}$ < | $8.3\times10^{-6}$ |

N: No good
F: Fair
G: Good
E: Excellent

The significance of A<B has beed described in conjunction with FIGS. 10A and 10B, regarding Embodiment 7. In this embodiment, if the developing operation is performed under the condition defined by the above-described equations (5)–(8), then the toner is not sufficiently capable of reciprocating between the developing sleeve and the photosensitive drum in the one period of the alternating voltage when the voltage V0 is 150–250 V approximately. In addition, when the alternating voltage is stopped, the DC component functions to attract to the photosensitive drum such an amount of the toner as corresponds to the latent image potential, and therefore, the dot missing defect can be avoided.

By repetition of intermittent oscillation on the photosensitive drum, the toner particles are concentrated on the latent image portion, so that each dot is faithfully reproduced, and therefore, a uniform halftone image can be produced even at a portion short of toner supply from the developing roller 11. The images thus produced are better than the images produced in accordance with Embodiment 7.

In the non-image portion, the surface potential is normally slightly higher than the DC component of the developing bias voltage as in this embodiment in order to avoid the fog. For this reason, the voltage Vcont in equations (6) and (7) is negative in the non-image portion, and therefore X+<X− is satisfied. In addition, the alternating voltage is stopped, and therefore, the DC component functions to attract the toner toward the developing sleeve, therefore, the toner particles are deviated toward a developing sleeve, and therefore, the fog is further reduced.

In this embodiment, the alternating voltage applied is as shown in FIG. 9A, but the present invention is not limited to this. For example, as shown in FIG. 9B, two-period application with 5-period rest, or as shown in FIG. 9C, one period-on and 10 period-rest, is usable. In this embodiment, rectangular waveform is used, which, however, may be replaced with a triangular waveform, sine waveform or the like. The most suitable application can be selected properly by one skilled in the art in accordance with the copying speed or developing conditions.

A ratio of the bias application period and the rest period is preferably 1:(½)–1:15.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member for bearing an electrostatic image;

a developer carrying member, opposed to said image bearing member, for carrying a developer comprising toner particles and carrier particles;

electric field forming means for forming an intermittently alternating electric field between said image bearing member and said developer carrying member by applying a substantially rectangular developing bias voltage to said developer carrying member, wherein the developing bias voltage has an oscillating portion having a continuous plurality of oscillating voltage levels and has a rest portion having a non-oscillating voltage level.

2. An apparatus according to claim 1, wherein said image bearing member is disposed across a predetermined gap from said developer carrying member, said image bearing member contacting carrier particles formed into chains.

3. An apparatus according to claim 1, wherein said image bearing member comprises a photosensitive layer, and further comprising means for selectively exposing said photosensitive layer to a light spot that is turned on and off in accordance with an image signal.

4. An apparatus according to claim 3, wherein said image bearing member carries toner particles on the portion thereof which has been exposed to the light spot.

* * * * *

UNITED STATES PATENT AND TRADEMARK OFFICE

CERTIFICATE OF CORRECTION

PATENT NO. : 5,610,696 Page 1 of 3

DATED : March 11, 1997

INVENTOR(S) : KAZUHISA KEMMOCHI, ET AL.

It is certified that error appears in the above-identified patent and that said Letters Patent is hereby corrected as shown below:

On the title page, item
[56] References Cited

OTHER PUBLICATIONS

"No. 182,P376," should read --No. 182, P376,--.
"Document JP43-19677." should read --Document JP 40-19677--.

COLUMN 1:

Line 57, "rather local images." should read --rather a local image.--.

COLUMN 2:

Line 44, "frequency:" should read --frequency,--.

COLUMN 4:

Line 21, "and magnetic particles." should be deleted.

UNITED STATES PATENT AND TRADEMARK OFFICE

CERTIFICATE OF CORRECTION

PATENT NO. : 5,610,696 Page 2 of 3

DATED : March 11, 1997

INVENTOR(S) : KAZUHISA KEMMOCHI, ET AL.

It is certified that error appears in the above-indentified patent and that said Letters Patent is hereby corrected as shown below:

COLUMN 5:

Line 60, "accordance" should read --in accordance--.

COLUMN 6:

Line 46, "reference" should read --with reference--.
Line 54, "pored" should read --poured--.

COLUMN 7:

Line 14,"the" should read --a--.

UNITED STATES PATENT AND TRADEMARK OFFICE

CERTIFICATE OF CORRECTION

PATENT NO. : 5,610,696 Page 3 of 3

DATED : March 11, 1997

INVENTOR(S) : KAZUHISA KEMMOCHI, ET AL.

It is certified that error appears in the above-indentified patent and that said Letters Patent is hereby corrected as shown below:

COLUMN 12:

Line 36, "conditions" (second occurrence) should read --the conditions--.

COLUMN 15:

Line 27, "beed" should read --been--.

COLUMN 16:

Line 2, "therefore," should be deleted.

Signed and Sealed this

Eleventh Day of November, 1997

Bruce Lehman

*Attest:*

BRUCE LEHMAN

*Attesting Officer*

*Commissioner of Patents and Trademarks*